US007597546B2

(12) United States Patent
Brieske

(10) Patent No.: US 7,597,546 B2
(45) Date of Patent: Oct. 6, 2009

(54) HOSE PUMP

(75) Inventor: Gerhard Brieske, Ampfing (DE)

(73) Assignee: Lifebridge Medizintechnik AG, Amplfing (DE)

( * ) Notice: Subject to any disclaimer, the term of this patent is extended or adjusted under 35 U.S.C. 154(b) by 422 days.

(21) Appl. No.: 11/366,342

(22) Filed: Mar. 2, 2006

(65) Prior Publication Data

US 2006/0204388 A1 Sep. 14, 2006

(30) Foreign Application Priority Data

Mar. 10, 2005 (EP) ..... 05005264

(51) Int. Cl.
*F04B 43/08* (2006.01)
*F04B 45/06* (2006.01)
*F04B 43/12* (2006.01)

(52) U.S. Cl. ..... 417/477.11; 417/477.9

(58) Field of Classification Search ..... 417/477.1, 417/477.11, 477.9, 474, 476, 360, 477; 403/13, 403/14

See application file for complete search history.

(56) References Cited

U.S. PATENT DOCUMENTS 2,987,005 A * 6/1961 Dann ..... 417/477.7
3,358,609 A * 12/1967 Worth et. al. ..... 417/477.6
3,756,752 A * 9/1973 Stenner ..... 417/477.1
3,832,096 A * 8/1974 Gelfand ..... 417/475
4,070,725 A * 1/1978 Austin et al. ..... 417/236
4,138,205 A * 2/1979 Wallach ..... 417/360
4,441,867 A * 4/1984 Berelson ..... 417/475
4,604,038 A * 8/1986 Belew ..... 417/475
4,631,008 A * 12/1986 Stenner ..... 417/477.1
4,909,713 A * 3/1990 Finsterwald et al. ..... 417/477.1
5,096,393 A * 3/1992 Van Steenderen et al. ... 417/475
5,249,938 A * 10/1993 Hall ..... 417/477.3
5,256,041 A * 10/1993 Tucker ..... 417/477.9
5,447,417 A * 9/1995 Kuhl et al. ..... 417/477.11
5,586,872 A * 12/1996 Skobelev et al. ..... 417/477.8
5,709,539 A 1/1998 Hammer et al.
5,741,125 A * 4/1998 Neftel et al. ..... 417/477.7
5,759,017 A * 6/1998 Patton et al. ..... 417/477.9
5,941,696 A * 8/1999 Fenstermacher et al. . 417/477.6
6,120,263 A * 9/2000 Kosters ..... 417/477.1
6,468,059 B2 * 10/2002 Haser et al. ..... 417/477.1
2005/0053502 A1 * 3/2005 Souza ..... 417/477.11

FOREIGN PATENT DOCUMENTS

DE 2 162 998 A1 6/1973
DE 100 62 600 A1 6/2002
EP 0 786 596 A 7/1997

* cited by examiner

*Primary Examiner*—Charles G Freay
*Assistant Examiner*—Alexander B Comley
(74) *Attorney, Agent, or Firm*—Workman Nydegger

(57) ABSTRACT

A peristaltic hose pump has a rotor which is rotatable by a drive shaft as well as a support element which extends along a part of the rotor periphery. A flexible hose is inserted between the support element and the rotor. The support element is movable in the direction toward the rotor by rotation of the drive shaft.

9 Claims, 2 Drawing Sheets

HOSE PUMP

Figure 1:
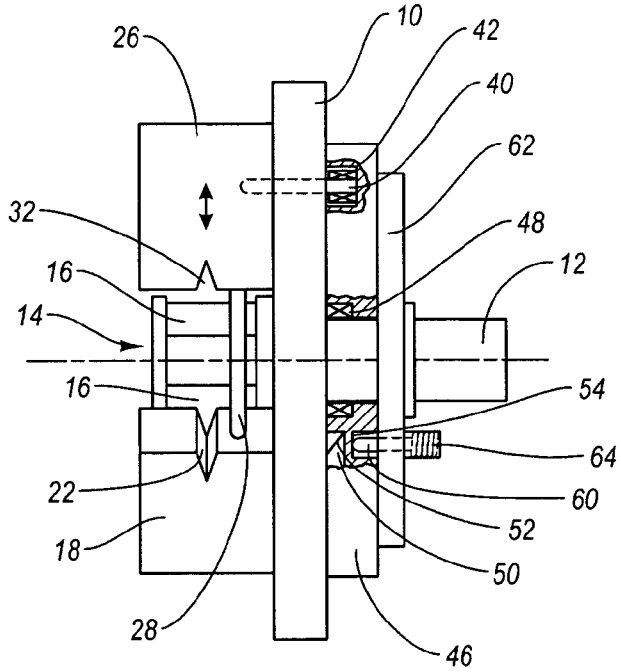

The present invention relates to a peristaltic hose pump in accordance with the preamble of claim 1. Hose pumps of this type are generally known and include a rotor rotatable by a drive shaft and a support element extending along a part of the rotor periphery, with a flexible hose being insertable between the support element and the rotor. By a rotation of the drive shaft, the rotor is set into rotation and in this process presses against the flexible hose with pressing elements, typically rollers, with the support element serving as a counter support. A fluid, e.g. a liquid, located in the hose is thereby pressed in the direction of rotation by the hose.

It is the object of the present invention to improve a peristaltic hose pump in accordance with the preamble of claim 1 such that the insertion of the hose between the support element and the rotor is simplified.

This object is satisfied by the features of claim 1 and in particular in that the support element is movable by a predetermined distance in the direction toward the rotor by rotation of the drive shaft in a first direction of rotation.

In accordance with the invention, the support element is movable in the direction toward the rotor and preferably also away from the rotor by a predetermined distance so that the space for the insertion of the hose can be enlarged and reduced. The support element can be located spaced somewhat further away from the rotor for the insertion of the hose so that the hose is insertable into the intermediate space thus provided in a simple manner. Subsequently, only the drive shaft has to be set into rotation, whereby the support element moves by a predetermined distance in the direction toward the rotor so that the hose is subsequently clamped between the rotor and the support element so that a pump operation can be initiated.

It is possible in accordance with the invention only to insert the hose transporting the liquid into the intermediate space between the rotor and the support element and subsequently to move the support element by rotation of the drive shaft so far in the direction toward the rotor that the hose is clamped somewhat between the rotor and the support element. A blood-carrying module can thereby be inserted into the machine, for example, with heart-lung machines, in a simple manner without the hose of the blood-carrying module having to be manually clamped tight in the hose pump. It is rather sufficient for the module with blood-carrying parts to be placed onto the hose pump such that the flexible hose moves into the intermediate space between the rotor support element. The clamping of the hose subsequently takes place automatically and in a self-acting manner by actuation of the hose pump.

Advantageous embodiments of the invention are described in the description, in the drawing and in the dependent claims.

In accordance with a first advantageous embodiment, the support element remains in its position on a further rotation of the drive shaft in the first direction of rotation and after moving of the support element by the predetermined distance in the direction toward the rotor. It is possible in this manner that no further measures have to be taken to initiate a proper pump operation after the clamping of the flexible hose between the support element and the rotor. The hose is first clamped solely by rotation of the drive shaft in the first direction of rotation and subsequently the rotor is rotated in a customary manner so that the rollers of the rotor can press liquid through the hose.

In accordance with a further advantageous embodiment, the support element can be moved away from the rotor by the predetermined distance again by rotation of the drive shaft in a direction opposed to the first direction of rotation. It is possible in this manner to release the clamping of the hose between the rotor and the support element again only by rotation of the rotor in the opposite direction of rotation so that the flexible hose or the module connected thereto can be removed from the pump. It is advantageous in this process for the support element to remain in its position on a further rotation of the drive shaft in the direction opposite to the first direction of rotation and after movement by the predetermined distance away from the rotor, since in this case a freewheel clutch is provided so that it is not critical if the drive shaft is also rotated further when the support element has already moved away from the rotor by the predetermined distance.

In accordance with a further advantageous embodiment of the invention, a mating piece can be provided which, together with the support element, forms a clamping device in which the hose can be clamped by movement of the support element in the direction toward the rotor. A clamping device of this type can be additionally provided for the clamping of the hose between the rotor and the support element to fix the hose in a fixed location.

In accordance with a further advantageous embodiment, the support element is coupled to the drive shaft via a coupling device. The support element can thereby be moved in the direction toward the rotor or away from the rotor by actuation of the coupling so that the rotation of the drive shaft simultaneously effects the movement of the support element.

In accordance with a further advantageous embodiment of the invention, a drive plate provided with a spiral guide is provided for the movement of the support element and is rotatable around the drive shaft. It is possible by a spiral guide of this type to convert the rotational movement of the drive shaft via a driver into a linear movement by which the support element is movable in the direction toward the rotor.

To couple the support element with the drive shaft and to decouple it from it, it can additionally be advantageous for a ring groove to be provided in the drive plate in which a fixed position cam guide engages. A sprung blocking pin, which runs around together with the drive shaft, can be controlled by this fixed position cam guide such that the drive plate loses the coupling with the drive shaft or is coupled to the drive shaft after approximately one rotation. It can be advantageous for this purpose for a drive pin rotationally fixedly connected to the drive shaft to be provided which is displaceably supported against the force of a spring in the axial direction of the drive shaft. A drive pin of this type can enter into engagement with the fixed position cam guide through an opening in the base of the ring groove and can thereby couple the drive plate on a change in the direction of rotation over approximately one rotation to the rotational movement of the drive shaft.

It is also advantageous in this process for the drive plate to have at least one guide chamfer, whose lowest point is the opening, in the region of the opening on the side opposite the ring groove. In this manner, the drive pin can first slide along the guide chamfer and subsequently move through the opening. By a suitable choice of the guide chamfer and of the cam guide, a coupling of the drive plate to the drive shaft can thereby be achieved depending on the direction of rotation for approximately one rotation.

Figure 2:
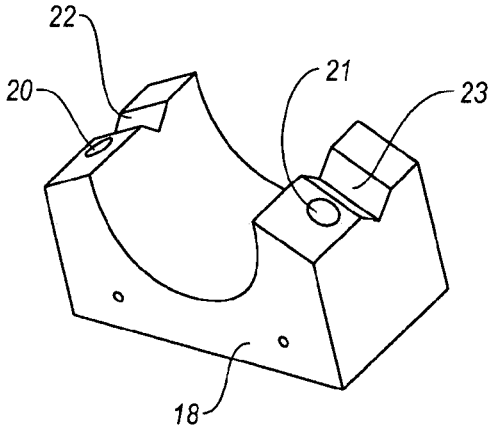
Figure 3:
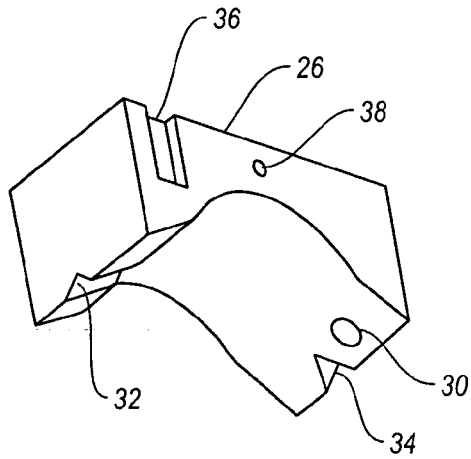
Figure 4:
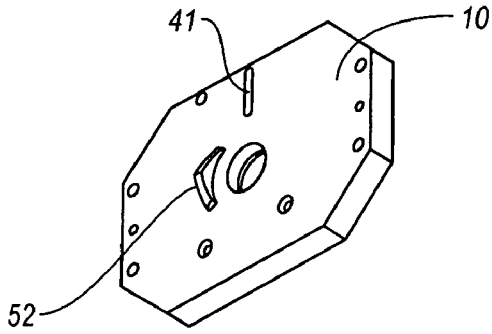
Figure 5:
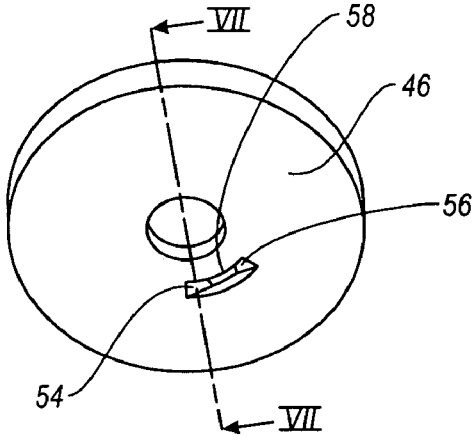
Figure 6:
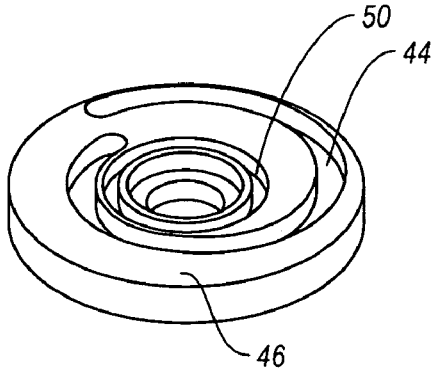
Figure 7:
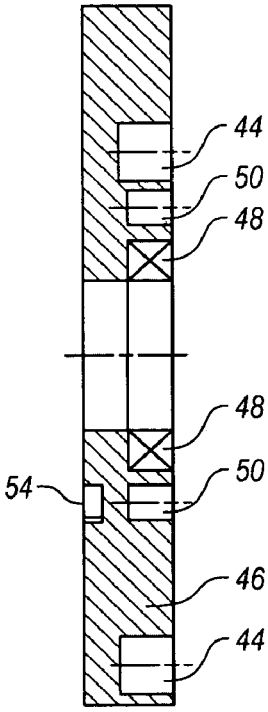
Figure 8:
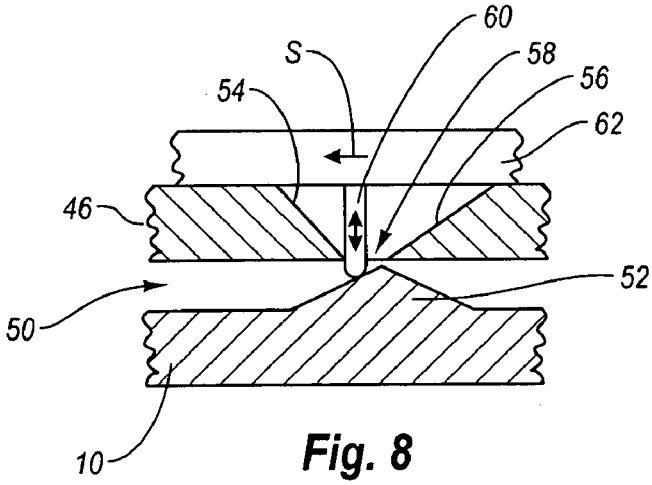

The present invention will be described in the following purely by way of example with reference to an advantageous embodiment and to the enclosed drawings. There are shown:

FIG. 1 a side view of a peristaltic hose pump;

FIG. 2 the mating piece of the hose pump of FIG. 1;

FIG. 3 the support element of the hose pump of FIG. 1;

FIG. 4 the support plate of the hose pump of FIG. 1;

FIG. 5 a perspective view of that side of the drive plate of the hose pump of FIG. 1 which is remote from the support plate;

FIG. 6 a perspective view of the drive plate of FIG. 5 on that side which is remote from the support plate in the hose pump of FIG. 1;

FIG. 7 a section through the drive plate of FIGS. 5 and 6 along the line VII-VII; and FIG. 8 an enlarged representation of the coupling device of the hose pump of FIG. 1.

The peristaltic hose pump shown in FIG. 1 has a support plate 10 which can be installed in a fixed position and has a bore through which a drive shaft 12 is rotatably inserted. The end of the drive shaft 12 at the right in FIG. 1 can be driven by a drive not shown in more detail, for example by an electric motor, whereby a rotor 14 attached to the end of the drive shaft 12 at the left in FIG. 1 likewise rotates. The rotor 14 has a plurality of rollers 16 which are distributed over its periphery and which serve in a known manner to press liquid through a flexible hose (not shown).

A mating piece 18, which is shown in a perspective view in FIG. 2, is screwed beneath the rotor 14 to the support plate 10 at the side of the support plate 10 at the left in FIG. 1. As FIG. 2 shows, the mating piece 18 has two vertical blind bores 20 and 21, on the one hand, and two V-shaped grooves 22 and 23, on the other hand, which extend at an angle to the horizontal and extend inside one and the same vertical plane. The mating piece 18 furthermore has an approximately semi-circular opening in which the rotor can rotate freely.

FIG. 1 furthermore shows that a support element 26 is provided above the rotor 14 which is movable in the direction of the double arrow by a predetermined distance in the direction toward the rotor 14 or by this predetermined distance away from the rotor 14. That state is shown in FIG. 1 in which the support element has been completely moved away from the rotor 14 by the predetermined distance.

Two guide pins 28 (only one is shown in FIG. 1), which are inserted into the blind bores 20 and 21 of the mating piece, serve for the guidance of the support element 26. As FIG. 3 shows, the support element 26 likewise has two blind bores 30 (only one is shown in FIG. 3) so that the support element 26 is guided by the guide pins 28.

FIG. 3 furthermore shows that the support element 26 also has two V-shaped grooves 32 and 34 which, together with the grooves 22 and 23 of the mating piece 18, form a clamping device in which the hose can be clamped by a movement of the support element in the direction toward the rotor. A groove 36 provided at the rear side of the support element 26 serves for the insertion of a metal piece to permit a contact free position detection with the help of a sensor (not shown). It can furthermore be recognized that a blind bore 38 is provided centrally at the rear side of the support element 26. A pin 40 is inserted into this blind bore, said pin being recognizable in FIG. 1, extending through an elongate hole 41 in the support plate 10 and simultaneously serving as an end abutment for the movement of the support element 26. The pin 40 projects somewhat from the support plate 10 on the side thereof opposite to the support element 26 and the projecting end of the pin 40 is inserted into a plain bearing 42 which is movable in a spiral groove 44 (cf. FIG. 6) of a drive plate 46.

The drive plate 46 is shown in more detail in FIGS. 5 to 7 and is placed freely rotatably onto the drive shaft 12 via a plain bearing 48. FIG. 6 shows a view of that side of the drive plate 46 which faces the support plate 10. As can be recognized, the spiral groove 44 extends from the outer rim of the drive plate 46 in the direction of the center, with the spiral groove extending over an angle of somewhat more than 180°. A ring groove 50 is provide at the interior of the spiral groove 44 and serves for the reception of a fixed position cam guide 52 which is made integrally with the support plate 10 (cf. FIG. 4). As FIG. 4 and also FIG. 8 illustrate, the fixed position guide cam 52 has a rising and a falling flank of the same gradient. In this process, the guide cam 52 is curved in the peripheral direction such that it fits into the ring groove 50 of the drive plate 46.

FIG. 5 shows the side of the drive plate 46 disposed at the bottom in FIG. 6. As can be recognized, a curved recess is provided at this side of the drive plate 46 which has two guide chamfers 54 and 56 whose lowest point forms an opening 58 through which a passage into the ring groove 50 is created. This passage serves for the passing through of a drive pin 60 which, as described in the following, serves as a coupling member between the drive shaft 12 and the drive plate 46.

FIG. 1 shows that a drive plate 62 is rotationally fixedly connected to the drive shaft 12, with the drive pin 60 being resiliently supported in a sleeve 64 provided at the drive plate 62 such that it is displaceably supported against the force of the spring in the axial direction of the drive shaft 12. When the drive shaft 12 thus rotates, the drive plate 62 and also the drive pin 60 rotate together with it. In this process, the drive pin 60 presses against the drive plate 46 due to the spring and the front end of the drive pin 60 runs on the drive plate on an orbit which is indicated by a broken line in FIG. 5. If, in this process, the drive pin 60 moves into the region of the guide chamfers 54 and 56, the front end of the drive pin 60 moves on these guide chamfers until it moves through the opening 58 in the drive plate.

The function of the previously described peristaltic hose pump will be described in the following.

The starting position is the situation shown in FIG. 1 in which the support element 26 has been moved away from the rotor 14 by the predetermined distance. In this position, the drive pin 60 is located in the situation shown in FIG. 8 in which it projects through the opening 58 in the drive plate 46 and its front end lies on the fixed position cam guide 52. If, in this process, the drive shaft 12 and thus the drive wheel 62 are moved against the arrow direction S, the drive pin 60 is moved to the right in FIG. 8 and first runs on the fixed position cam guide 52 and subsequently on the guide chamfer 56 of the drive plate 46 which merges constantly into the left hand flank of the fixed position cam guide 52. Subsequently, the drive pin 60 runs on the orbit shown by a broken line in FIG. 5 until it again moves toward the guide chamber 54 and slides along on this until the situation of FIG. 8 again results. This means that the drive shaft can be rotated as desired against the arrow direction shown in FIG. 8, without the drive plate 46 moving.

After a flexible hose has been inserted into the intermediate space between the support element 26 and the rotor 14, the direction of rotation of the drive shaft 12 is reversed and now runs in the direction of the arrow S shown in FIG. 8. However, this means that the drive pin 60 abuts the lower end of the guide chamfer 54, as shown in FIG. 8, so that, on a further rotational movement, the drive plate 46 is taken along by the drive pin 60 and likewise rotates in the direction of the arrow S. In this process, the front end of the follow pin runs along the falling flank of the cam guide 52 until it revolves on the orbit shown by a broken line in FIG. 4.

On this rotation of the drive plate 46, the plain bearing 42 simultaneously runs in the spiral orbit 44 and thereby moves in the direction of the axis of rotation, whereby the pin 40 in the elongate bore 41 is likewise moved in the direction of the axis of rotation. This has the consequence that the support element 26 is moved by the predetermined distance in the direction toward the rotor 14 such that the flexible hose (not shown) is respectively clamped between the V grooves 22 and 32 and 23 and 34. At the same time, the hose is clamped between the support element 26 and the rotating rollers 16 of the rotor 14 so that a pump effect is achieved.

After a complete revolution of the drive pin 60 on the orbit shown in a broken line in FIG. 4, said drive pin moves from the right side in FIG. 8 back up to the cam guide 52 an subsequently slides upwardly on this until the front end moves onto the guide chamfer 54 of the drive plate 46 constantly adjoining the cam guide 52 at this point in time. The drive pin 60 then slides further upwardly on this guide chamfer 54 until the front end of the drive pin 60 revolves on the orbit shown in a broken line in FIG. 5. When the drive shaft is rotated further in the direction of the arrow S, the drive pin 60 can revolve for any desired length of time without effecting a movement of the drive plate 46. Only when the direction of rotation is reversed again does the drive pin 60 again couple with the drive plate 46 in that it moves through the opening 58 and slides downwardly on the fixed position cam guide 52. The front end of the drive pin 60 subsequently again revolves once on the orbit shown by a broken line in FIG. 4 until the situation shown in FIG. 8 again results.

REFERENCE NUMERAL LIST

| | |
|---|---|
| 10 | support plate |
| 12 | drive shaft |
| 14 | rotor |
| 16 | rollers |
| 18 | mating piece |
| 20, 21 | blind bore |
| 22, 23 | V groove |
| 26 | support element |
| 28 | guide pins |
| 30 | blind bores |
| 32, 34 | V groove |
| 36 | groove |
| 38 | blind bore |
| 40 | pin |
| 41 | elongate hole |
| 42 | plain bearing |
| 44 | spiral groove |
| 46 | drive plate |
| 48 | plain bearing |
| 50 | ring groove |
| 52 | fixed position cam guide |
| 54, 56 | guide chamfers |
| 58 | opening |
| 60 | drive pin |
| 62 | drive plate |
| 64 | sleeve |
| S | direction of rotation |

The invention claimed is:

1. A peristaltic hose pump comprising:

a rotor rotatable by a drive shaft; and a support element extending along a part of the rotor periphery, with a flexible hose being insertable between the support element and the rotor, wherein the support element is movable by a predetermined distance in the direction toward the rotor by rotation of the drive shaft in a first direction of rotation, wherein a drive plate rotatable about the drive shaft is provided which is provided with a spiral guide that guides the movement of the support element, wherein a ring groove is provided in the drive plate into which a fixed position cam guide engages, wherein the drive plate has at least one guide chamfer, whose lowest point is an opening in the base of the ring groove, in the region of the opening on the side opposite the ring groove.

2. A hose pump in accordance with claim 1, wherein the support element remains in its position on a further rotation of the drive shaft in the first direction of rotation and after a movement by the predetermined distance in the direction toward the rotor.

3. A hose pump in accordance with claim 1, wherein the support element can be moved away from the rotor by the predetermined distance by rotation of the drive shaft in a direction opposite to the first direction of rotation.

4. A hose pump in accordance with claim 3, wherein the support element remains in its position on a further rotation of the drive shaft in the direction opposite to the first direction of rotation and after a movement away from the rotor by the predetermined distance.

5. A hose pump in accordance with claim 1, wherein the support element forms a clamping device together with a mating piece in which the hose can be clamped by movement of the support element in the direction toward the rotor.

6. A hose pump in accordance with claim 1, wherein the support element is coupled to the drive shaft via a coupling device.

7. A hose pump in accordance with claim 1, wherein a drive pin rotationally fixedly connected to the drive shaft is provided which is displaceably supported against the force of a spring in the axial direction of the drive shaft.

8. A hose pump in accordance with claim 1, wherein a drive pin can be brought into engagement with the cam guide through the opening in the base of the ring groove.

9. A peristaltic hose pump comprising:

a rotor rotatable by a drive shaft;

a support element extending along a part of the rotor periphery, with a flexible hose being insertable between the support element and the rotor;

a drive plate rotatable about the drive shaft, the drive plate having a spiral guide and at least one guide chamfer;

a ring groove provided in the drive plate into which a fixed position cam guide engages; and a drive pin rotationally fixedly connected to the drive shaft, the drive pin being displaceably supported against the force of a spring in the axial direction of the drive shaft, wherein the drive pin can be brought into engagement with the cam guide through an opening in the base of the ring groove;

wherein the lowest point of the at least one guide chamfer is the opening, in the region of the opening on the side opposite the ring groove, and wherein the support element is movable by rotation of the drive shaft in a first direction of rotation by a predetermined distance in the direction toward the rotor

* * * * *